US005753895A

United States Patent [19]

Olson et al.

[11] Patent Number: 5,753,895

[45] Date of Patent: May 19, 1998

[54] MICROWAVE POPCORN PACKAGE WITH ADHESIVE PATTERN

[75] Inventors: Robert P. Olson; Denise Ellen Hanson, both of Elk River, Minn.

[73] Assignee: Golden Valley Microwave Foods, Inc., Edina, Minn.

[21] Appl. No.: 587,306

[22] Filed: Jan. 16, 1996

[51] Int. Cl.[6] ..... H05R 6/80; B65D 81/34

[52] U.S. Cl. ..... 219/727; 219/730; 426/107; 426/234; 99/DIG. 14; 383/109

[58] Field of Search ..... 219/727, 725, 219/730, 759; 426/107, 234, 243; 99/DIG. 14; 383/109–116

[56] References Cited

U.S. PATENT DOCUMENTS

| | | | |
|---|---|---|---|
| 3,851,574 | 12/1974 | Katz et al. . | |
| 3,973,045 | 8/1976 | Brandberg et al. . | |
| 4,038,425 | 7/1977 | Brandberg et al. . | |
| 4,220,684 | 9/1980 | Olson | 383/116 |
| 4,398,994 | 8/1983 | Beckett . | |
| 4,461,031 | 7/1984 | Blamer | 383/113 |
| 4,517,045 | 5/1985 | Beckett . | |
| 4,552,614 | 11/1985 | Beckett . | |
| 4,571,337 | 2/1986 | Cage et al. . | |
| 4,610,755 | 9/1986 | Beckett . | |
| 4,685,997 | 8/1987 | Beckett . | |
| 4,727,706 | 3/1988 | Beer . | |
| 4,797,010 | 1/1989 | Coelho . | |
| 4,848,931 | 7/1989 | Kamada et al. | 426/107 |
| 4,878,765 | 11/1989 | Watkins et al. . | |
| 4,904,488 | 2/1990 | LaBaw et al. . | |
| 4,943,456 | 7/1990 | Pollart et al. | 219/730 |
| 4,973,810 | 11/1990 | Brauner . | |
| 4,982,064 | 1/1991 | Hartman et al. . | |
| 5,011,299 | 4/1991 | Black, Jr. et al. . | |
| 5,038,009 | 8/1991 | Babbitt . | |
| 5,044,777 | 9/1991 | Watkins et al. . | |
| 5,081,330 | 1/1992 | Brandberg et al. . | |
| 5,171,594 | 12/1992 | Babbitt | 426/107 |
| 5,195,829 | 3/1993 | Watkins et al. . | |
| 5,383,596 | 1/1995 | Gulliver et al. | 229/120.17 |

OTHER PUBLICATIONS

Declaration of Robert P. Olson.

Declaration of Denise E. Hanson and attached Exhibits, A–B, D–G.

Declaration of Robert H. Blamer and attached Exhibits C and H–I.

*Primary Examiner*—Philip H. Leung

*Attorney, Agent, or Firm*—Merchant, Gould, Smith, Edell, Welter & Schmidt, P.A.

[57] ABSTRACT

A microwave popcorn package is provided. The package generally comprises plies of flexible material, such as paper, bonded or adhered to one another, with a microwave interactive construction therebetween. The laminating adhesive between the plies is applied in a preferred pattern, to advantage.

11 Claims, 10 Drawing Sheets

MICROWAVE POPCORN PACKAGE WITH ADHESIVE PATTERN

FIELD OF THE INVENTION

The present invention relates to materials and packaging for use as expandable bag arrangements for popping microwave popcorn.

BACKGROUND OF THE INVENTION

Many microwave popcorn popping constructions in common commercial use are multi-ply paper bags in which inner and outer paper sheets are laminated to one another, with a microwave interactive construction (sometimes referred to as a microwave susceptor) encapsulated between the paper plies. Popcorn popping bags of this type are described, for example, in U.S. Pat. Nos. 4,904,488; 4,973,810; 4,982,064; 5,044,777; and 5,081,330, the disclosures of which are incorporated herein by reference.

A common feature of such constructions is that they are generally made from flexible paper materials. In this manner, the constructions are sufficiently flexible to open or expand conveniently under steam pressure, when a popcorn charge therein is exposed to microwave energy in a microwave oven. Also the materials are sufficiently flexible to be formed from a sheet into a folded configuration, for example during a continuous bag-construction process.

Many microwave popcorn products include, within the bag, a charge of unpopped popcorn kernels, fat/oil (i.e. grease) and flavor (for example salt). During storage or shipment, especially if the environment becomes relatively hot, the material stored within the bag can become liquefied and leak through the bag construction. Even when relatively high temperatures are not encountered in storage, some leakage can occur if the stored material includes a significant amount of flowable or liquefied oil/fat.

In addition, conventional microwave cooking of popcorn (especially when the popcorn charge includes fat/oil) results in the generation of hot liquid oil or fat. If the construction retaining the popcorn charge is paper, the paper must be sufficiently resistant to staining and to the passage of hot liquid oil/fat therethrough, during the microwave cooking process, to be satisfactory for performance of the product. For example, the oil/fat should not leak from the construction, when the microwave cooking (i.e. popping) is undertaken, sufficiently to generate an undesirable greasy feel or appearance, to the outside of the package.

SUMMARY OF THE INVENTION

According to the present invention, a microwave popcorn package or bag is provided. The package generally comprises a flexible bag construction having inner and outer plies, and a microwave interactive construction positioned between the inner and outer plies. Generally the microwave interactive construction has a front side and a back side; and, the inner ply is bonded to the outer ply by an adhesive. According to the invention, the adhesive is oriented in an adhesive pattern having at least a first portion which comprises adhesive applied in a first pattern of lines covering no more than about 50% of the surface of a first one of the plies, in that first portion. In that first portion, the adhesive pattern is preferably provided in a pattern of regular polygons, typically and preferably a pattern of hexagons. In certain preferred arrangements, the adhesive pattern also includes as a second portion, a first outer border of adhesive along an outer perimeter of one of the plies. This outer border preferably comprises a perimeter border having a width of 0.625 inches to 1.125 inches (1.59 to 2.86 cm).

In certain preferred arrangements, the adhesive pattern includes, as a third portion, a central microwave interactive construction overlap region. The overlap region should generally comprise a rectangular pattern having a width of about 0.125 inch–0.5 inch (0.31 to 1.27 cm) greater than the width of a microwave susceptor positioned on the region, and a length of about 0.125 inch to 0.5 inch (0.31–1.27 cm) greater than the length of a microwave interactive construction or susceptor positioned thereon. The following sizes are typical for microwave interactive constructions, and various sized arrangements according to the present invention: 5.25×6.0 inches (13.3 ×15.2 cm); 5.75×6.5 inches (14.6×16.51 cm); and, 4.25×4.0 inches (10.8 cm×10.16 cm). Such susceptor sizes, which turn generally upon the size of the microwave bag involved, generally dictate then the size of the microwave interactive construction overlap region. It is noted that typical arrangements, such as those referenced above, involve generally rectangular microwave interactive constructions.

In some preferred arrangements, the adhesive in the rectangular pattern in the central microwave interactive construction overwrap region is a continuous, rectangular pattern of adhesive. In others, it may be provided in a pattern having a frame or border, defining a central non-adhesive covered area. In still others it may comprise the same pattern of regular polygons utilized elsewhere on the construction, however in general this latter will not be preferred.

When the adhesive in the central overlap region comprises a rectangular frame pattern, preferably it has a width of about 0.25 inches to 1.0 inch (0.63 cm to 2.5 cm). Preferably its width is wide enough to overlap the microwave interactive construction by at least 0.25 inches and to also form a border around the microwave interactive construction of at least 0.25 inches.

In general, arrangements according to the present invention may be utilized to provide good effective microwave packaging, especially for popcorn, with savings over the amount of adhesive, and thus cost, utilized in many conventional arrangements.

DETAILED DESCRIPTION OF THE INVENTION

I. Certain Specific Disadvantages in Prior Systems

In general, conventional microwave popcorn bag constructions comprise two-ply systems, with laminating adhesive applied therebetween. Generally the laminating adhesive is applied over the entire space, between the two plies. This provides some disadvantages. For example, it is relatively expensive, in terms of cost of adhesive.

Secondly, it adds substantial weight to packaging, which is less desirable both for: practical concerns such as shipping; and, also, because it is less desirable for operation since a greater weight in a packaging requires more heat/steam pressure for expansion.

Also, larger amounts of adhesive between the layers can add stiffness to the overall construction, potentially reducing the ability of the arrangement to puff up or expand during use.

II. Certain Principles of Processes and Materials According to the Present Invention According to the present invention, instead of applying adhesive to the entire region between the plies, of a multi-ply bag arrangement, the adhesive is applied in a pattern. Preferably the pattern is selected such that there is an overall reduction in the total amount of adhesive between the plies, of at least 35% by weight, and preferably about a total reduction of 40–70% by weight.

In certain arrangements, as will be apparent from the more detailed discussions below, in certain portions or regions a pattern of adhesive lines is used and the pattern is selected such that where the pattern of adhesive is positioned, 70% less adhesive is used, per unit area. In preferred arrangements, certain other portions or regions comprise complete adhesive coverage, to advantage.

Figure 1:
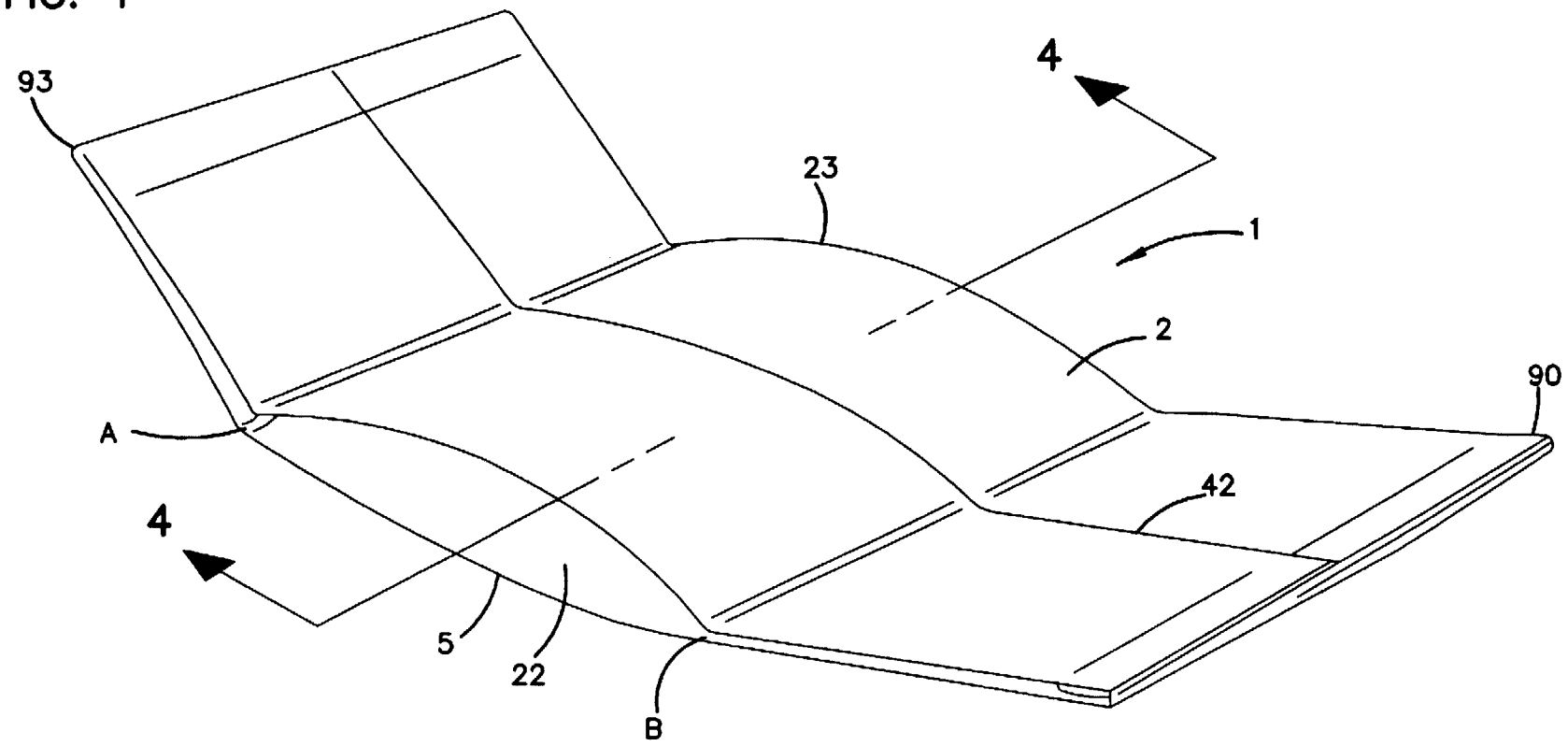
FIG. 1 is a perspective view of a microwave bag construction, according to the present invention, depicted unfolded and prior to expansion, in use.

III. Microwave Packaging for Popcorn Including Improvements According to the Present Invention The reference numeral 1, FIG. 1, generally depicts a microwaveable popcorn package incorporating the various advantages according to the present invention. In FIG. 1, package 1 is depicted as it generally would appear when unpackaged from its protective outer wrap, and positioned by a consumer in a microwave oven for use. Prior to this step, packages such as package 1 are often stored and sold in a "trifold" configuration, with folding being generally about fold lines A and B. In the trifold configuration, the arrangement is generally sold and stored in a protective moisture barrier outer wrap, not shown. These have been conventionally utilized for a wide variety of microwave bags.

In general, microwave popcorn package 1 comprises a flexible outer bag 2 including a charge of popcorn or popcorn and fat therein. In use, during exposure to microwave energy, the popcorn is popped and the bag expands. This is described, for example, in U.S. Pat. Nos. 5,044,777 and 5,081,330, incorporated herein by reference. In this context, the term "flexible" is meant to refer to a bag material which is not so stiff or rigid as to undesirably interfere with bag expansion during use. Alternately stated, the term is used to refer to a material that can be readily folded and unfolded.

In general, prior to popping, the popcorn is retained in central region 5, of bag 2. In this region, the unpopped popcorn charge would generally be positioned oriented above a microwave interactive construction. During the popping operation, moisture inside the popcorn kernels absorbs microwave energy, generating sufficient steam and heat for the popping operation. In addition, the microwave interactive construction absorbs microwave energy and dissipates heat, facilitating the popping process. In preferred constructions, the microwave interactive construction occupies central region 5, but not, to a substantial extent, other portions of the popcorn package 1. That is, microwave interactive material is preferably confined to the region where it will be in proximity with, and mostly where it will be covered by, a popcorn charge in use. This is preferred, at least since it leads to efficient utilization of the microwave interactive material and also because it results in preferred heat transfer and heat retention in connection with the popping process.

Figure 4:
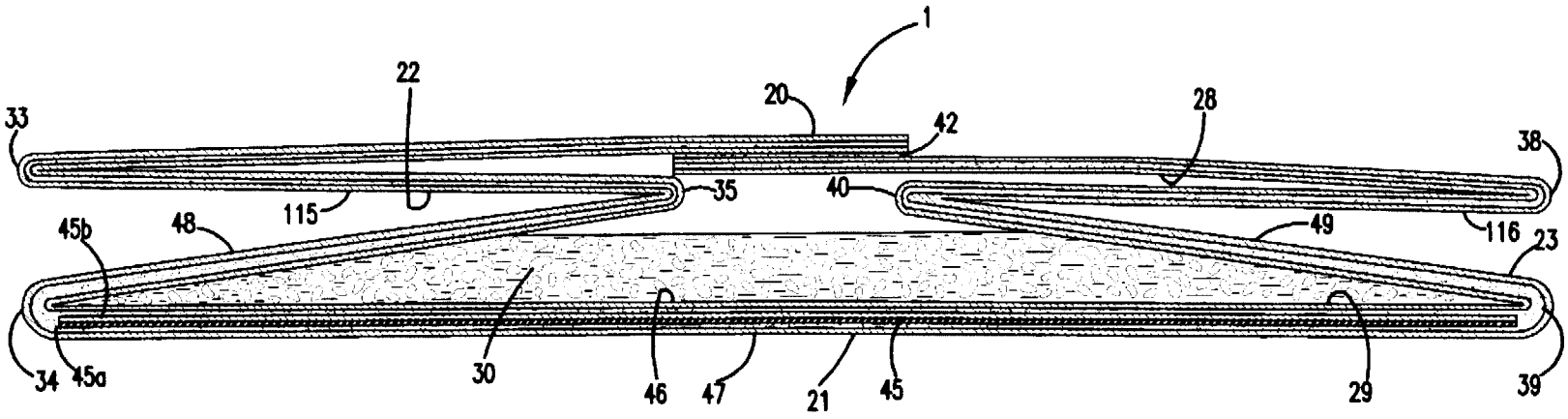
FIG. 4 is a cross-sectional view taken along line 4—4, FIG. 1.

Attention is now directed to FIG. 4, a cross-section taken generally along line 4—4, FIG. 1. From review of FIG. 4, it will be understood that the popcorn package 1 generally comprises first and second opposite panels 20 and 21, joined by first and second opposite side gussets 22 and 23.

The gussets 22 and 23 generally separate popcorn package 1 into first and second expandable tubes 28 and 29. Popcorn charge 30 is initially positioned and substantially retained within tube 29. Tube 28, prior to popping, is generally collapsed. Indeed, in preferred arrangements, tube 28 is sealed closed by temporary heat seals, prior to heating in the microwave oven. Still referring to FIG. 4, side gusset 22 generally comprises edge folds 33 and 34 and inwardly directed central fold 35. Similarly, gusset 23 comprises edge folds 38 and 39 and inwardly directed central fold 40.

Package 1, for the arrangement shown in FIG. 4, is folded from a multi-ply (i.e. a double-ply) blank (typically 12 inches by 21 inches, i.e. about 30.5×53.3 cm in size). Thus, panel 20 includes central longitudinal seam 42 therein. Folds such as folds 33, 34, 35, 38, 39 and 40 are widely used for flexible microwave packaging, for example they are shown at U.S. Pat. Nos. 5,044,777 and 5,195,829, and products using such folds are available under the commercial designation ACT II® from Golden Valley Microwave Foods, Inc. of Edina, Minn., the assignee of the present application. The folds 33, 34, 35, 38, 39 and 40 define, inter alia, gusset panels 48 and 49.

The popcorn charge 30 may in some cases comprise unpopped kernels, in some instances flavored unpopped kernels, and in some instances it may comprise a mixture of unpopped kernels and oil/fat. When the charge 30 comprises a mixture of unpopped kernels (whether flavored or not) and oil/fat, in some systems preferably the oil/fat will be a material which is liquified at about 105° F. Under such circumstances, generally for preferred systems the weight of kernels to weight of oil/fat will preferably be in the range of about 2:1 to 20:1.

Underneath popcorn charge 30, arrangement 1 includes microwave interactive construction or susceptor 45. The microwave interactive construction 45 may be of conventional microwave interactive stock. In the particular multi-ply (two-ply) arrangement 1 depicted, it is positioned between layers or plies 46, 47 from which flexible construction 1 is folded.

Preferred microwave interactive constructions for arrangements according to the present invention, are described herein below. Preferably when the microwave interactive construction is a laminate as described hereinbelow, it extends past fold lines A and B, FIG. 1, somewhat. Preferably it extends toward the openable top end 90, past fold line B about 0.4 to 1.0 inch (1 cm to 2.54 cm); and, it extends toward bottom end 93, i.e. past fold line A, about 0.25 to 0.5 inch (0.63 to 1.27 cm). The reason it is preferred that it extend somewhat further toward the top openable end 90 than the bottom closed end 93 is that generally the V-seals, described hereinbelow, at the bottom end, are a bit larger than the V-seals, described below, adjacent the top end.

Attention is again directed to FIG. 4. For the arrangement shown in FIG. 4, the microwave interactive construction 45 comprises two layers; i.e., a layer of flexible microwave transparent polymeric material 45*a* and a field of microwave interactive metallic material 45*b* positioned thereon. If it is desired to have heating occur around the folds 34, 39, the microwave interactive material can be extended into these regions. Also, there is no requirement that the metal cover the entire surface of the polymerized portions of the polymer can be folded around folds 34 and 39.

Figure 5:
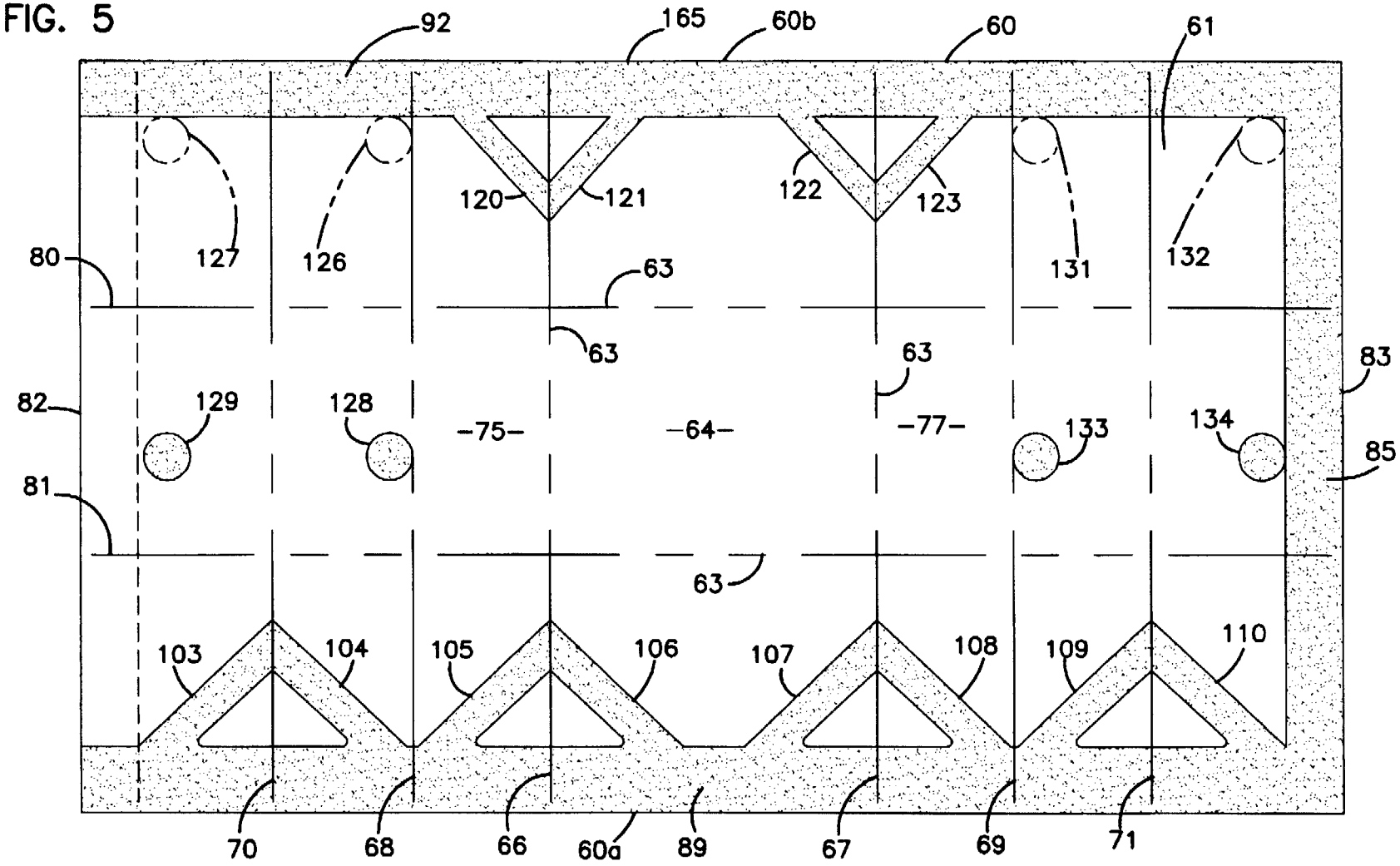
FIG. 5 is a plan view of the inside surface of a blank from which the arrangement of FIGS. 1 and 2 can be folded.

Attention is now directed to FIG. 5. FIG. 5 is a top plan view of a panel, sheet or blank 60, from which an arrangement according to FIGS. 1 and 2 can be folded. Many of the features illustrated in FIG. 5 are generally known features, for example shown and described in U.S. Pat. Nos. 5,195,829 and 5,044,777.

Figure 6:
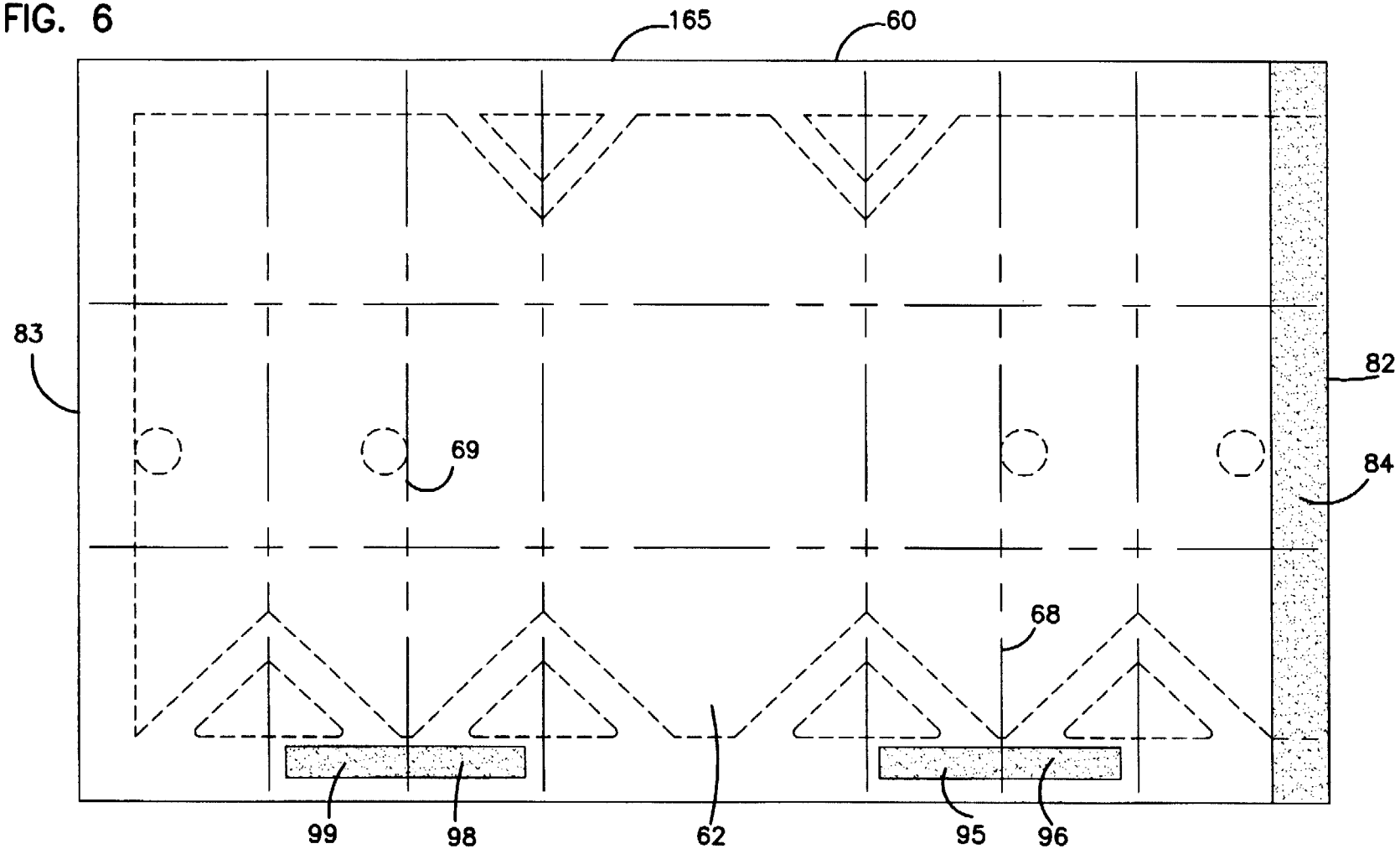
FIG. 6 is a bottom plan view of the blank shown in FIG. 3.

The view of FIG. 5 is of what is sometimes referred to as the "backside" of panel 60, i.e., the side 61 of panel 60 which forms the interior surface of the assembled bag construction 1, FIG. 1. The side opposite the side viewable in FIG. 5, which is depicted in FIG. 6 at 62, is sometimes referred to as the "front side", and forms the exterior surface of the bag construction 1. Thus, referring to FIG. 5, panel 60 comprises a sheet of flexible material from which arrangement 1 is folded, and panel 60 includes various sealant fields thereon, to generate desired features.

Still referring to FIG. 5, phantom line segments 63 define a region 64 with which at least a portion of a microwave interactive construction, such as susceptor construction 45, will be associated in use. The perimeter defined by phantom lines 63 also indicates a location on surface 61 whereat the popcorn charge will eventually be positioned, in use. The microwave interactive construction, for example interactive construction 45, FIG. 4, may be positioned on the interior of the construction 1, on the exterior, or between plies. In general, for preferred embodiments such as those shown in FIGS. 1 and 4, microwave interactive construction 45 will be positioned between plies.

Referring to FIG. 5, the surface 61 viewed is the surface which, when package 1 is folded, forms the interior surface of the construction. The popcorn charge 30 (shown in FIG. 4) will eventually be positioned over central region 64, defined by perimeter lines 63.

Still referring to FIG. 5, line 66 generally indicates where fold 34, FIG. 4, will be formed; and, line 67 generally indicates where fold 39, FIG. 4, will be formed. Similarly, line 68 corresponds with fold 40 (FIG. 4), line 69 with fold 35 (FIG. 4), line 70 with fold 36 (FIG. 4) and line 71 with fold 33 (FIG. 4). Thus, region 75, between fold lines 68 and 66, will eventually define panel 49, FIG. 4; and, region 77, between fold lines 67 and 69, will eventually define panel 48, FIG. 4.

Figure 2:
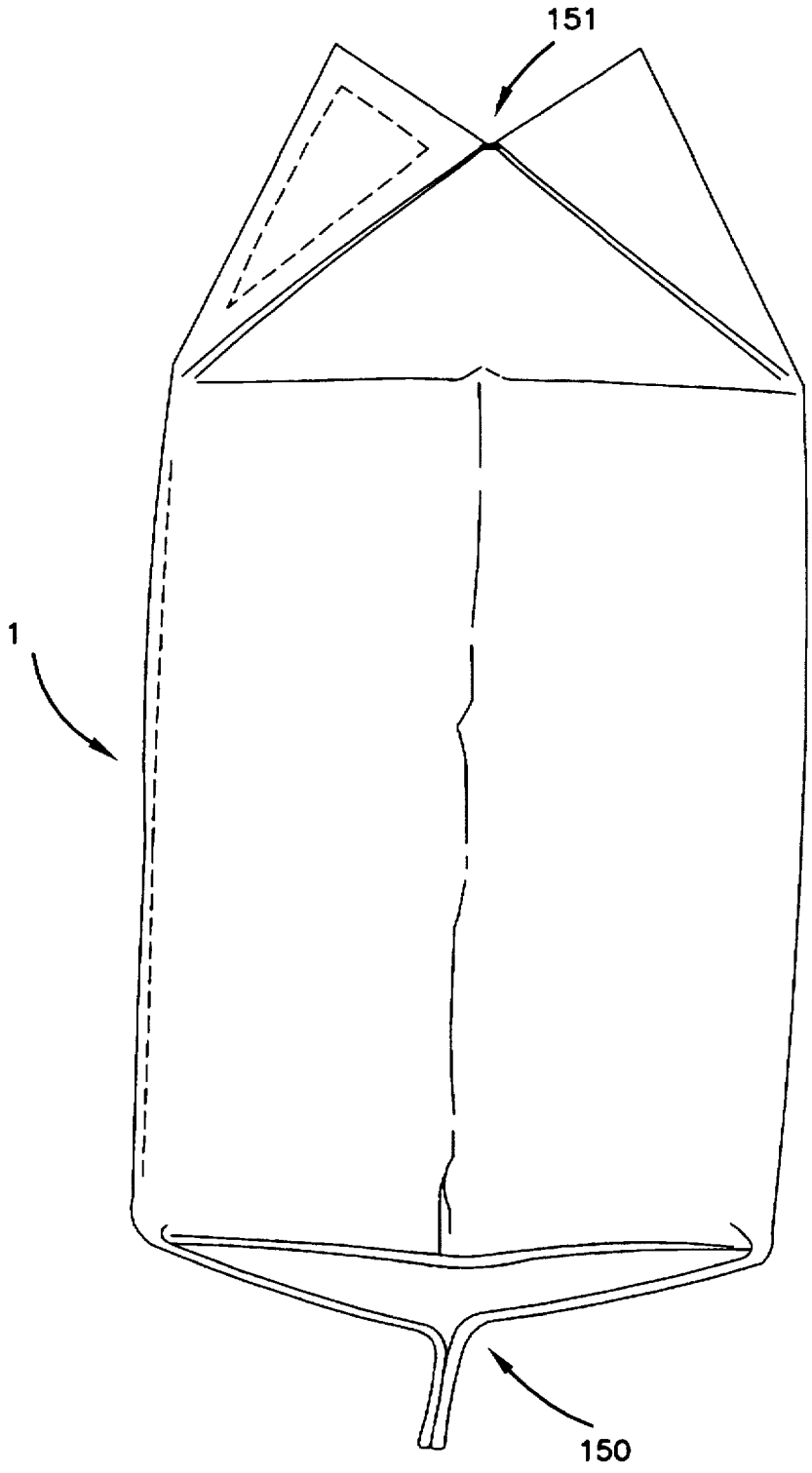
FIG. 2 is a side view of the arrangement depicted in FIG. 1, after expanding during a microwave popping operation, but depicted before it is opened, for access to popped popcorn.

Referring to FIG. 5, in general folds A and B (FIG. 1) are eventually formed by folding the overall arrangement such that folds along lines 81 and 80, respectively, are created. This later folding would generally be after the bag construction, FIGS. 1 and 2, is assembled.

Attention is now directed to FIG. 6. FIG. 6 is a view of panel 60, shown flipped over, relative to FIG. 3. For orientation, in FIG. 6, edges 82 and 83 are opposite to FIG. 5. Sealant field 84 is used to engage field 85 (FIG. 5), during folding (with heat sealing), to form longitudinal seam or seal 42, FIG. 4.

Referring to FIG. 5, during folding (and with heat sealing), various portions of field 89 will engage one another to form end seal 93, and various portions of field 92 will engage one another to form end seal 90, FIG. 1. In general, end seal 90 is located at a "top end" of the construction, and is sized and configured to vent under internal steam pressure, during use. End 93, on the other hand, forms the bottom end and remains sealed during use. The consumer's typical access to the popcorn is through "top" end 90. This is described in the '777 patent referenced above, and is discussed below in connection with FIGS. 2 and 3.

Portions of each of sealant fields 95 and 96, on an underside of panel 60, FIG. 6, will engage (overlap) one another when folding around fold line 68 is conducted (with heat sealing), to help secure panel 60 in a preferred configuration, after folding. This is analogous to what was done in the arrangement of U.S. Pat. No. 5,195,829, FIG. 1(*a*), at sealant fields 82 and 84. Similarly, sealant fields 98 and 99, on an underside of panel 60, FIG. 6, engage one another (with heat sealing) when the panel is folded about fold line 69.

Referring again to FIG. 5, attention is now directed toward sealant fields 103, 104, 105, 106, 107, 108, 109 and 110, sometimes referred to as V-seals or diagonal seals. Analogous fields were shown in U.S. Pat. No. 5,195,829, FIG. 1, at reference numerals 64–67. During folding, portions of fields 103–110 engage (overlap) one another, to retain selected portions of the panel tacked to one another (with heat sealing) and to provide for a preferred configuration during expansion. In particular, field 103 engages field 104, field 105 engages field 106, field 108 engages field 107, and field 110 engages field 109, during folding (and heat sealing). Engagement between fields 105 and 106, and also fields 108 and 107, tends to retain selected portions of panels 49 and 48 secured to panel 21, FIG. 4, in regions where the popcorn charge is not located, in the collapsed folded trifold. Sealing of field 103 against 104, and field 110 against 109, helps retain panels 116 and 115 sealed against panel 20, FIG. 4, in the collapsed trifold. This helps ensure that the popcorn charge 30, FIG. 4, is substantially retained where desired in the arrangement. Advantages from this are described in part in U.S. Pat. No. 5,195,829.

Referring again to FIG. 5, attention is now directed to sealant fields 120, 121, 122 and 123. When the arrangement is folded about fold line 66, sealant field 120 engages (overlaps) sealant field 121; and, when the arrangement is folded about fold line 67, sealant field 123 engages (overlaps) sealant field 122. The engagement (after heat sealing) between fields 120 and 121 further ensures that panel 49 will be sealed against panel 21; and, the engagement between fields 123 and 122 will further insure that panel 48 is sealed against panel 21. This is similar to the utilization of fields 68, 70, 71 and 72, FIG. 1, of U.S. Pat. No. 5,195,829. Fields 105, 106, 107, 108, 120, 121, 122 and 123 help ensure that the central section 5, FIG. 1, will remain relatively flat, as the bag expands in use.

Attention is now directed to sealant fields 128, 129, 133 and 134. These are also used to insure that panels 116 and 115 are sealed against panel 20, FIG. 4, so that the unpopped popcorn charge 30 is retained in tube 29, and does not substantially flow into tube 28 until desired during heating. In particular, fields 128 and 129 are oriented to engage (overlap) one another, when the arrangement is folded about fold line 70; and, fields 133 and 134 are oriented to engage (overlap) one another, when the arrangement is folded about fold line 71. Similarly, engagement between fields 103 and 104, and also between fields 109 and 110, ensures that tube 28 is maintained collapsed, until the bag begins to expand as the steam is generated and the popcorn pops. Optionally, fields 126 and 127 and fields 131 and 132 can be used, to further ensure that panels 116 and 115 are sealed against panel 20 in a desirable manner.

Seals of the type associated with fields 128, 129, 133 and 134 have been used in previous constructions. See for example, U.S. Pat. No. 5,044,777, FIG. 1, at 42, 44, 46 and 48.

In general, the material utilized for the end seals 90, 93 and seals involving regions 103, 104, 105, 106, 107, 108, 109, 110, 120, 121, 122, 123, 128, 129, 133 and 134 is preferably a heat sealable material, activated through the use of conventional type heat sealing equipment. That is, sealing does not occur merely upon contact, but rather requires some application of heat, such as the heating jaws of heat sealing equipment for activation. This is preferred in part because it allows the seal material to be applied using printing equipment, to rollstock. Thus, the rollstock can be rolled up without various layers of the arrangement becoming adhered to one another.

Attention is now directed to FIG. 2. FIG. 2 depicts the arrangement of FIGS. 1 and 4, as it would appear after having been expanded during a microwave popping process. In general, package 1 includes opposite ends 150 and 151. End 150 is generally the end corresponding to edge 60*a*, FIG. 5; and end 151 generally corresponds to edge 60*b*, FIG. 5.

Figure 3:
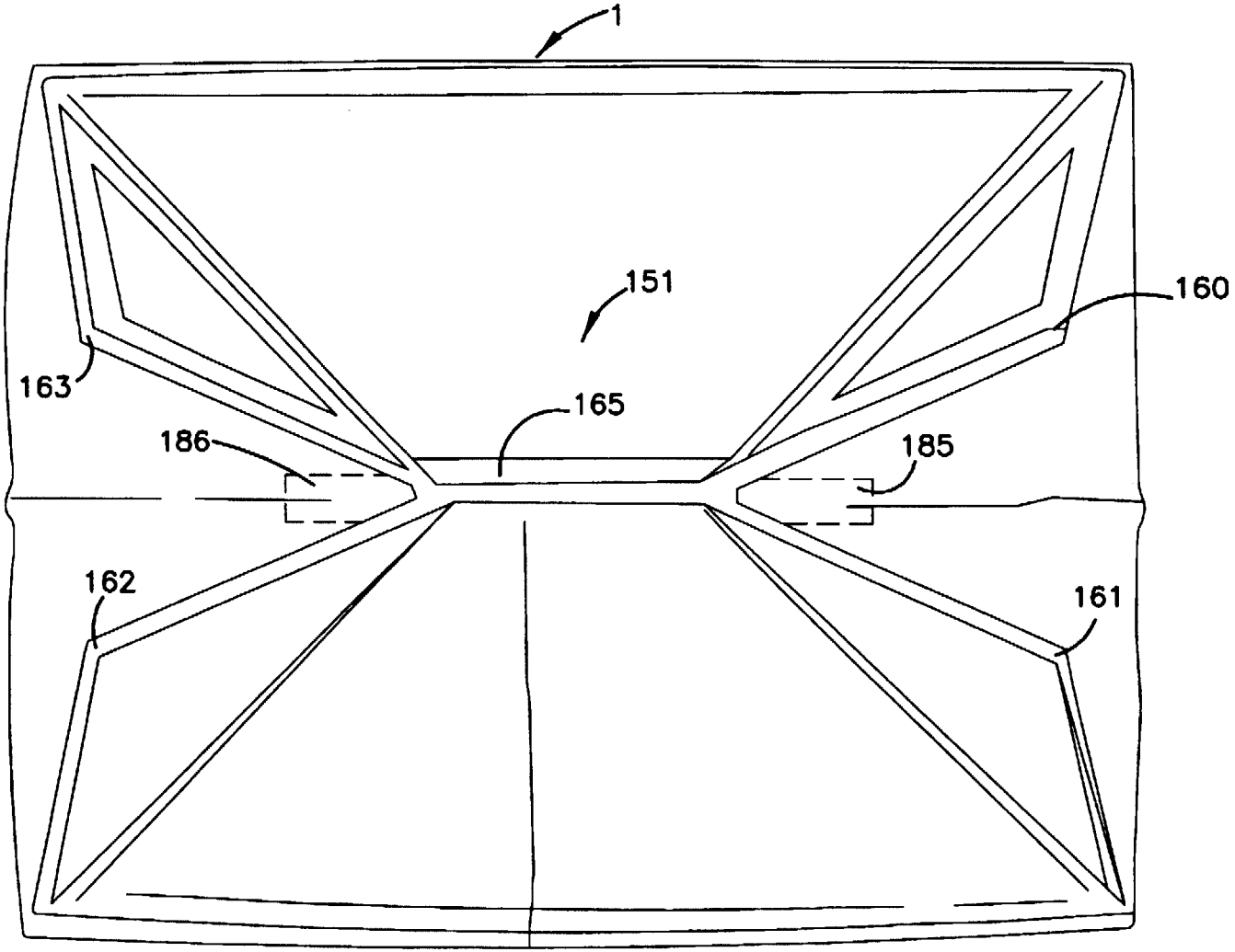
FIG. 3 is an end view of the arrangement depicted in FIG. 2.

FIG. 3 is an end view looking toward end 151, FIG. 2. As a result of the adhesive pattern depicted on FIGS. 5 and 6, the arrangement 1, FIG. 3, will form four tabs or ears 160, 161, 162 and 163, FIG. 3. After popping, venting will generally occur at region 165. In general, after a popping process, a consumer will open the arrangement 1, FIG. 3, by grasping two diagonally disposed ears, for example ears 160 and 162 or alternatively ears 161 and 163. Generally, by pulling them apart, the package 1 is opened. While other methods may be utilized to open the packaging, in general this appears to be the approach utilized by typical consumers in obtaining access to popcorn popped in such arrangements. It is convenient and avoids placing the fingers in the direct path of escaping steam/heat from the interior of the package.

IV. Improvements According to the Present Invention

Referring again to FIG. 4, in general the package construction comprises two plies, folded appropriately to make the bag 1. The panels depicted in FIGS. 5 and 6, then, preferably comprise two panels of greaseproof kraft paper of similar material, with a microwave interactive construction positioned therebetween. In the cross-section of FIG. 4, this is readily seen.

Referring to FIG. 4, since the microwave interactive construction 45 generally comprises a polymeric sheet 45*a* having microwave interactive material 45*b* such as a metal deposited on at least certain selected portions thereof, and typically on only one side thereof, it can generally be oriented in the arrangement in one of two manners: either with the metal directed toward the inside ply 46; or, with the metal directed toward the outside ply 47. It is foreseen that either arrangement is feasible, however, the arrangement depicted in FIG. 4, with the metal directed toward ply 46, will generally be preferred.

The present invention concerns the adhesive pattern applied between the two plies 46,47. With respect to this, attention is directed to the arrangement shown in FIG. 7.

Figure 7:
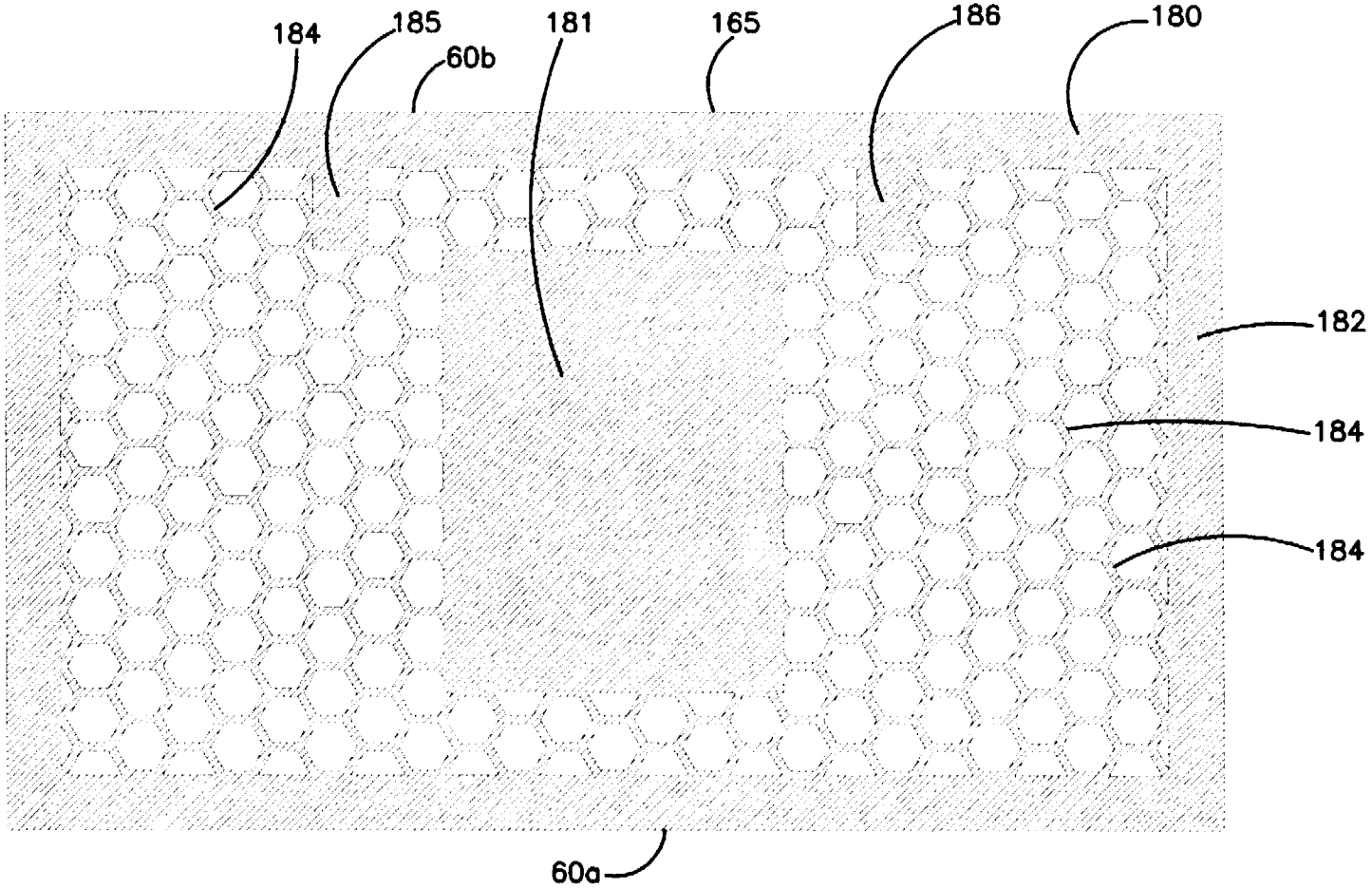
FIG. 7 is a schematic view of a glue pattern positioned between panels of the blank depicted in FIG. 5.

In FIG. 7, an outer ply 180 of a panel construction as shown in FIGS. 5 and 6, is depicted. This would correspond to ply 47, FIG. 4. In FIG. 7, a preferred glue pattern on panel 180 is depicted by the "gray" areas. The white areas comprise portions whereat no adhesive or glue is provided.

Referring to FIG. 7, panel 180 includes a portion or central region 181, having adhesive completely positioned thereover. Region 181 comprises a region commensurate in size to the area covered by microwave interactive material, in the microwave interactive construction. Thus, it is a microwave interactive material overlap region or portion. In particular, if a microwave interactive construction comprising aluminum metal on a polymeric backing is used, the region depicted at 181, FIG. 7, will comprise a region at least commensurate in size with the metal portion of the susceptor, and preferably a little larger. Thus, when ply 180 is secured to a second ply with a susceptor therebetween, the susceptor will be aligned such that its metal portion fits within region 181. The particular arrangement shown in FIG. 7, wherein the outer ply is depicted, is preferred for use in situations in which the polymeric backing of the microwave susceptor material is positioned toward the outer ply, and the microwave interactive region, i.e. the metal, is directed toward the inner ply. Thus, during assembly, between ply 180 and the actual metal of the microwave interactive material, will be positioned the polymeric sheet of the susceptor. Thus, ply 180 would be utilized in an arrangement as shown in the cross-section of FIG. 4.

Still referring to FIG. 7, reference numeral 182 depicts an outside border portion, again comprising a region completely covered by adhesive. Border 182, in preferred arrangements, will be about 0.625 to 1.125 inches wide (1.5 to 2.86 cm), throughout. It will facilitate avoidance of separation of the laminated sheets, of the two-ply arrangement.

Still referring to FIG. 7, reference numeral 184 is a pattern of adhesive depicted covering a substantial portion of the surface area of panel 180, as shown. The pattern 184, in preferred arrangements, generally comprises streams or lines of adhesive preferably no wider than about 1/16" (0.06 inch) wide, and typically about 1/32" to 1/16" wide; i.e. preferably no greater than about 0.15 cm and typically 0.07 to 0.15 cm. Preferably in the region having the line pattern, the average coverage of adhesive is about 10–50% of the area involved, and typically and preferably about 10–20%. Thus, in these regions, preferably 50–85% less glue is used, than if glue or adhesive were applied over the complete area.

A variety of patterns may be used. Generally, "regular" geometric patterns will be preferred, since weak spots will be avoided. Typically and preferably regular polygons, i.e. polygons with each side of the same length, will be preferred. The hexagonal pattern depicted is conveniently applied, but not required. It is foreseen that, for example, a pattern of diamonds, squares, etc. could be used as alternatives. It is noted that at the edges of the pattern, fragments of the regular polygons result, in the particular arrangement depicted, because the hexagons are aligned in a manner that they do not present a common, straight edge. This fragmenting will be used in many typical applications according to the present invention, but it is not required.

Attention is directed to the regions indicated at 185 and 186, FIG. 7. After a second panel is laminated to panel 180, with a microwave interactive construction positioned therebetween, and the arrangement is folded into a bag, the regions indicated at 185 and 186 will comprise, when the arrangement is expanded in use, regions between the two plies and underneath the outer ply 180 in the areas generally where indicated in phantom at 185 and 186, FIG. 3. These tabs will reinforce the two plies 46,47 (FIG. 4) at these locations, facilitating opening when the bag is opened in the conventional manner described above with respect to FIG. 3, by a consumer, after a popping operation. That is, continuous fields of adhesive in regions 185 and 186 tends to strengthen the laminated plies at these locations. This is advantageous, since it facilitates opening without destruction of the bag 1.

Referring again to FIG. 7, in general tabs 186 and 185 should comprise regions about 1 inch by 1.5 inches (2.5×3.8 cm), and typically and preferably within the size range of about 0.5 to 1.5 inches (1.27 to 8.8 cm) by 1.0 to 2.0 inches (2.5 to 5.1 cm). The regions should be positioned adjacent outside border 182 along an edge generally corresponding to the edge 165, FIG. 5. Such should extend over the centrally directed gusset folds 35 and 40, FIG. 4. Preferably each is centered on a corresponding gusset fold.

In preferred arrangements, the adhesive should be applied in an amount of about 5–6 lb/ream, in those areas where it is positioned. A variety of methods for application of adhesive may be utilized, including for example printing methods such as flexographic printing or gravure methods. When it is said that the adhesive should be applied in an amount of about 5–6 lb/ream, reference is meant to the specific point whereat the adhesive is applied. These would comprise then regions 181, 182, 185, 186 and in lines 184. With respect to this, reference is not meant to the overall average of adhesive taking into account locations where adhesive is not positioned.

A variety of adhesives may be utilized in arrangements according to the present invention. In general, the preferred adhesive as the laminating adhesive is Duracet 12. Indeed, the invention described is particularly well adapted for utilization with Duracet 12.

In general, FIG. 7 is a scale depiction of a preferred adhesive pattern. Thus, if a typical panel were made about 12 inches by 21 inches (i.e. about 30×53 cm), the same patterns as shown in FIG. 7 could be utilized, expanded for scale.

Figure 8:
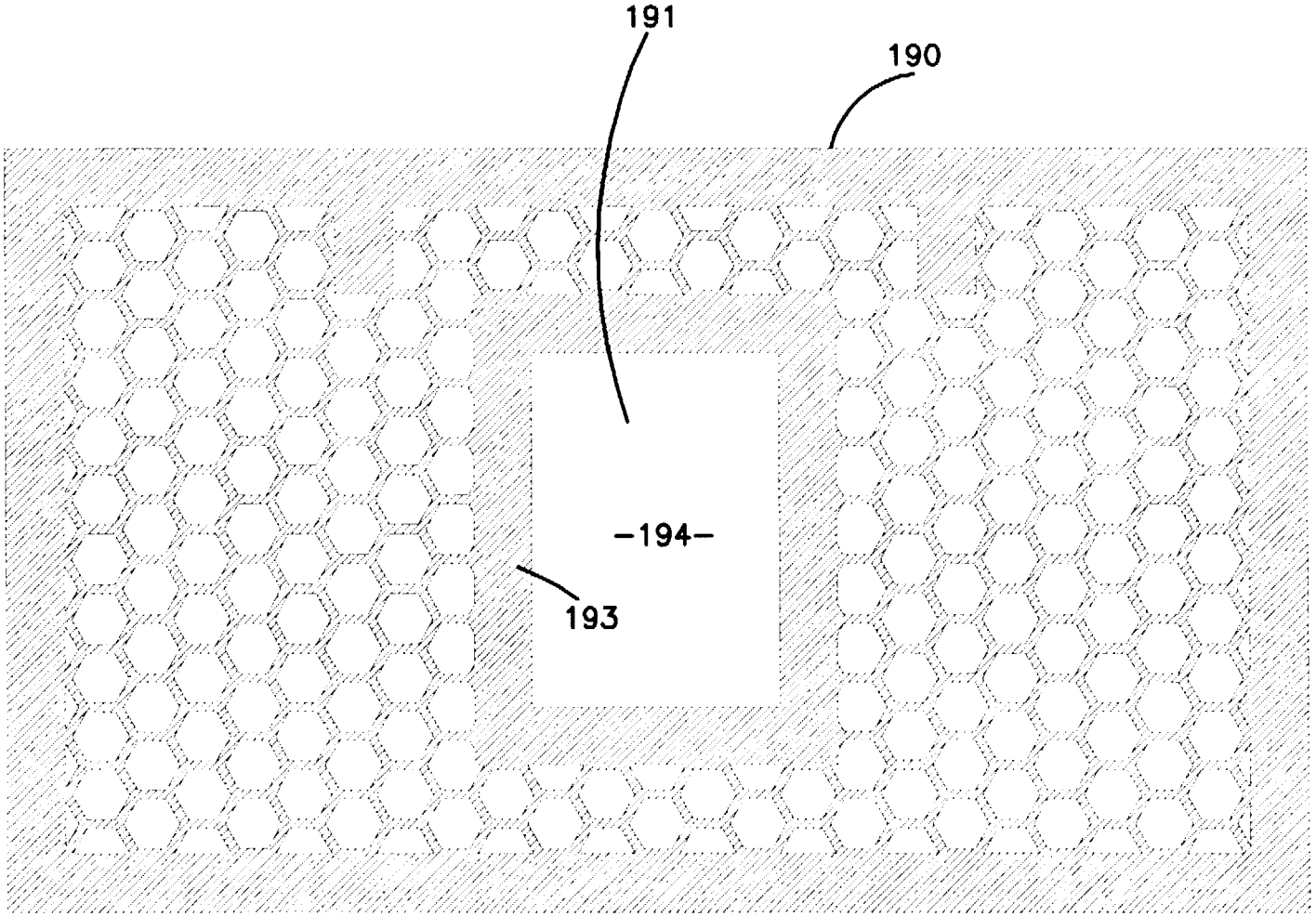
FIG. 8 is a schematic depiction of an alternate glue pattern, to that shown in FIG. 7.

Attention is now directed to FIG. 8. In general, in FIG. 8 a panel 190 generally analogous to panel 180, FIG. 7, is depicted. In FIG. 8, the panel 190 is shown with an adhesive pattern identical to that shown in FIG. 7, except for the pattern in region 191, by comparison to the pattern in region 181, FIG. 7. The pattern in region 191, FIG. 8, is shown with an outer border 193 and a central region 194, wherein no adhesive is presented. FIG. 8 will be usable to form a good, secure bond for the edges of the microwave interactive construction. However, the lamination in the area of the microwave interactive construction will be greater in the arrangement shown in FIG. 7, than in the arrangement shown in FIG. 8, since more adhesive is used in that region in FIG. 7, and it covers the entire region. In general, FIG. 7 may be preferred for various reasons, such as esthetics, but both should be generally operable arrangements.

Herein when it is said that the inner ply is bonded to the outer ply by an adhesive, and the adhesive is oriented in an adhesive pattern at least a first portion of which comprises an adhesive applied in a pattern of lines covering no more than, for example, about 50% of the surface area of a first one of the plies, in the first portion, reference is meant to the portion comprising the adhesive pattern of lines, not the entire surface of the ply to which the adhesive is applied. For example, in referring to FIG. 7, such a characterization is made with respect to the region comprising the "hexagonal" polygons, and not to the regions whereat complete coverage of adhesive is involved. Thus, such arrangements may include an outer border along an outer perimeter of one of the plies, as for example shown in FIGS. 7 and 8. It may also include a central microwave interactive construction overlap region, for example as indicated at reference numeral 181, FIG. 7; or at reference numeral 193, FIG. 8. The one indicated in 193, FIG. 8, may be characterized as a central microwave interactive construction overlap region comprising a border 193 of adhesive, rather than a continuous pattern, for example rectangular, of adhesive. Thus, the arrangement of FIG. 8 includes a rectangular frame pattern of adhesive having a central, non-adhesive, area.

The principles according to the present invention may be utilized in an arrangement wherein the adhesive is applied to the outer ply, with the microwave interactive construction secured thereto by the polymeric surface thereof; or, in an arrangement with adhesive applied to the inner ply, with the polymeric surface of the microwave interactive construction secured thereto. Thus, in some embodiments, the adhesive patterns of FIGS. 7 and 8 could be applied to the inner ply rather than the outer ply.

V. Processes for Preparing Preferred Constructions

Figure 9:
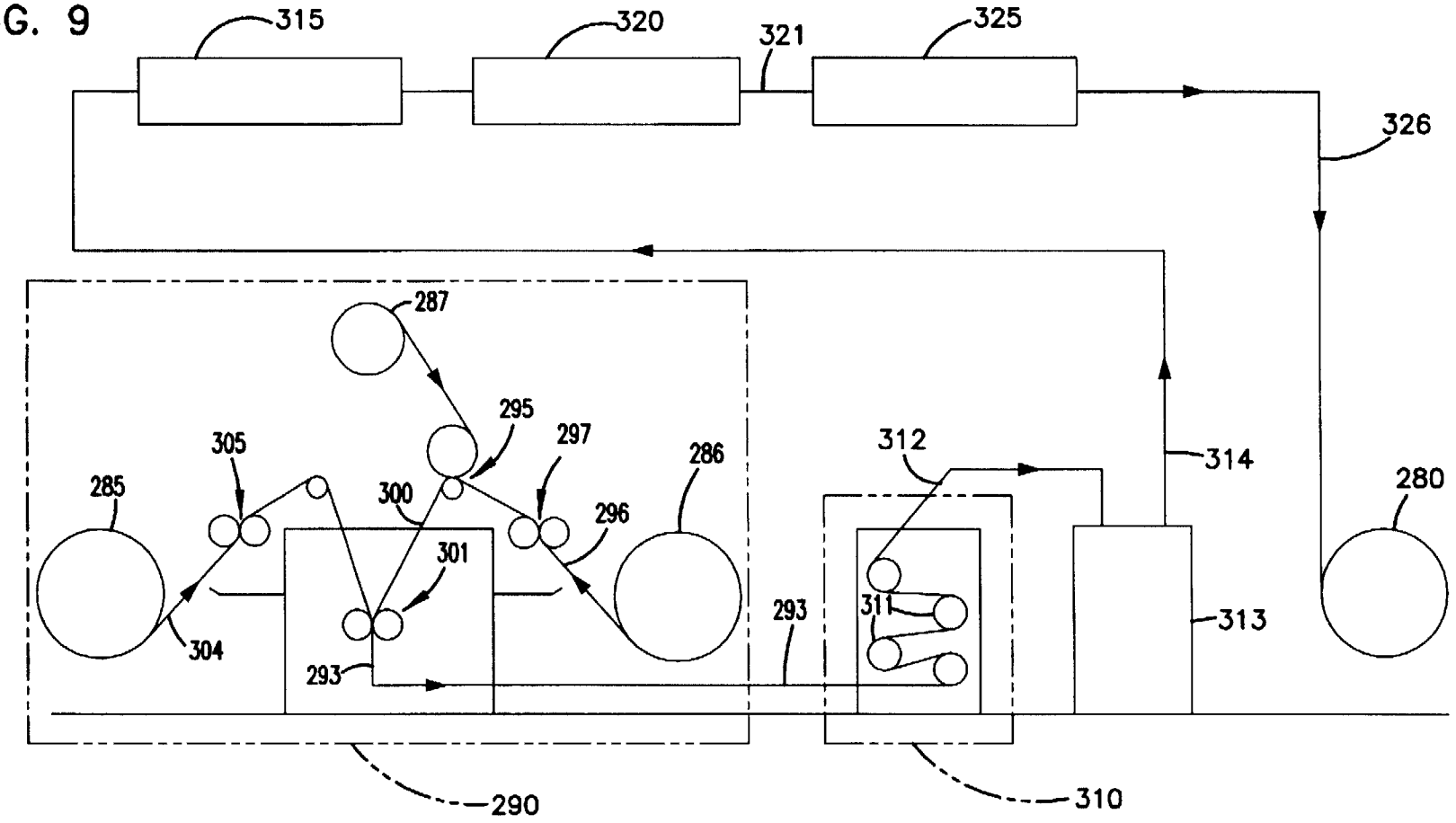
FIG. 9 is a schematic view of a process for preparing a rollstock of blanks according to FIGS. 5 and 6.

Attention is now directed to FIG. 9, which is a schematic representation for practicing certain preferred processes according to the present invention, to prepare rollstock from which advantageous microwave bag constructions can be made. It will be understood that a wide variety of techniques and methods can be used to prepare desirable rollstock. FIG. 9, and the discussion related thereto, is presented as an example of a usable technique. Many features of the operation shown in FIG. 9 are not necessarily preferred for any reason other than that they are readily made variations to a process already used to make conventional packaging.

Referring to FIG. 9, the rollstock prepared according to the schematic shown therein, is one which provides a rollstock of material having two plies of paper, with a microwave interactive material positioned therebetween. Thus, the rollstock prepared in the schematic of FIG. 9 could be used to prepare an arrangement such as that shown in FIGS. 1 and 4.

Referring to FIG. 9, the final rollstock material prepared according to the process is indicated generally at 280. The three feedstock materials used, are indicated generally at 285, 286 and 287.

Feedstock 287 comprises the microwave interactive construction, pre-prepared for use in processes according to the present invention. Thus, in general, feedstock 287 would comprise continuous metallized polymeric film. In typical preferred arrangements, the metal would be deposited and positioned on only one side of the polymeric film. The metal film need not cover the entire side on which it is applied, and may be presented in a pattern.

The feedstock indicated at 286 comprises the material which, in the overall assembly, will form the ply corresponding to the inside ply of the bag. In certain applications described herein, it may comprise a kraft paper. In some applications, it may be a greaseproof paper.

Feedstock 285 generally corresponds to the material which will form the outer ply, and thus is typically a bleached kraft paper. It will eventually form the ply corresponding to ply 180, FIG. 7, or ply 190, FIG. 8. In some applications, it will eventually be printed on, so it will often be a material which has a machine glazed finish. In some applications, it will be a material which has been treated with a fluorochemical treatment for grease-resistance. In others, it will not.

In FIG. 9, phantom lines 290 identify a first stage or stage 1 of the process. In this stage, the various feedstocks are laminated together to form a continuous feed or web 293, fed to downstream processing.

In general, referring to stage 1, 290, the processes conducted are as follows. Continuous feedstock 287 of microwave interactive material is fed to station 295, simultaneously with feedstock 286. At station 295, the two are laminated to one another. In general then, at station 295, a knife blade or cutter will be used to cut selected pieces of microwave interactive material from feedstock 287 for positioning on continuous paper stream 296. Conventional arrangements for cutting, such as those schematically shown in U.S. application Ser. No. 08/388,755, FIG. 11, may be used. At station 297, paper feed 296 from feedstock 286 has applied thereto an adhesive in an appropriate location for receipt of a section of microwave interactive construction to be laminated. Preferably the microwave interactive material comprises a sheet of polymeric material with a metal layer deposited on one side thereof. Preferably, the microwave interactive material is secured to web 296 with the metal layer positioned between web 296 and the polymeric sheet.

Preferably the adhesive applied at station 297 is an ethylene vinyl acetate copolymer adhesive. A usable, commercially available, product is Product No. WC-346OZZ from H. B. Fuller of Vadnais Heights, Minn.

At station 297 printing techniques, such as flexographic or gravure techniques, can be used to apply this adhesive.

Still referring to stage 1 (Ref. 290), at 300 a continuous feed of paper from rollstock 286, with patches of microwave interactive construction from feedstock 287, is depicted directed toward station 301. Simultaneously paper stock from feedstock 285 is shown directed to station 301 as a continuous web 304. At station 305, the laminating adhesive is applied to web 304. The laminating adhesive may be applied, for example, using flexographic or gravure techniques. It should be applied in a preferred pattern, according to the present invention.

At station 301, web 300, which will form a ply in the overall resulting construction, is pressed through a roller bite and is laminated, in a continuous operation, to web 304, which will also form a ply in the overall construction, with microwave interactive material between the paper sheets of the plies to form web 293.

At 310, a stage involving hot rollers 311 can be used, designed to facilitate drying of the adhesive. Such a stage is optional. At 312, the web is shown exiting this optional stage.

In general, it will be desired to provide printing or graphics on the outside of packages made from webs prepared according to the process. This can be conducted by directing the web 312 through a printing press (stage III), as indicated at 313. A wide variety of printing press arrangements can be used, including ones for applying multicolor printing or graphics. In general, at 314, a continuous, printed web is shown exiting the printing press 313.

In addition, in press 313, a grease-resistant treatment can optionally be applied to the surface of the web 312, which will become the outer surface of the package in use. This can be done either before or after the printing. In general, the treatment can be applied by a printing press analogously to the application of printing.

After exiting the press 313, with any desired printed indicia on the web and also any desired applied grease-resistant treatment, continuous web 314 is directed into a preliminary dryer 315. In general, in the dryer 315, the ink and the grease-resistant treatment are dried. Typically the dryer will comprise a forced-air dryer system running at about 150° to 250° F. The residence time in the dryer need only be sufficient to obtain a desired level of drying for the web. Typically a residence time sufficient to get a web temperature of 150° F. to 190° F. is preferred.

In typical applications, at this point it is still necessary to apply to the web, on appropriate surfaces thereof, the pattern of heat-seal adhesive to be used to form the desired seals when the bag is constructed. These would generally correspond to the fields of sealant indicated in FIGS. 5 and 6. In the schematic of FIG. 9, this step is represented as conducted at station 320. The heat-seal adhesive can be applied by conventional techniques, for example, using gravure or flexographic printing.

In general, at 321, the continuous web is shown with the heat-seal fields applied thereto, being fed into a final dryer 325. In the final dryer, the heat-seal adhesive is dried and final drying of the ink occurs. In general, this can be conducted readily with a forced-air dryer system, typically set at about 250° to 400° F.

At 326, the completed continuous web is shown being directed into final rollstock 280.

Processes such as those shown in FIG. 9 can be conducted to prepare printed rollstock with more than one sheet or bag oriented adjacent one another, on the final rollstock 280. This could later be split or cut to form individual streams to be fed into continuous bag-forming operations. A particularly convenient manner for orienting the printed bag blanks continuously on the webs to form a desirable rollstock 280, is with printed patterns of bags oriented side-by-side but rotationally offset by 90° (on the roller during printing). This helps ensure smooth operation of the application system, especially where the anilox transfers ink to the plates.

Figure 10:
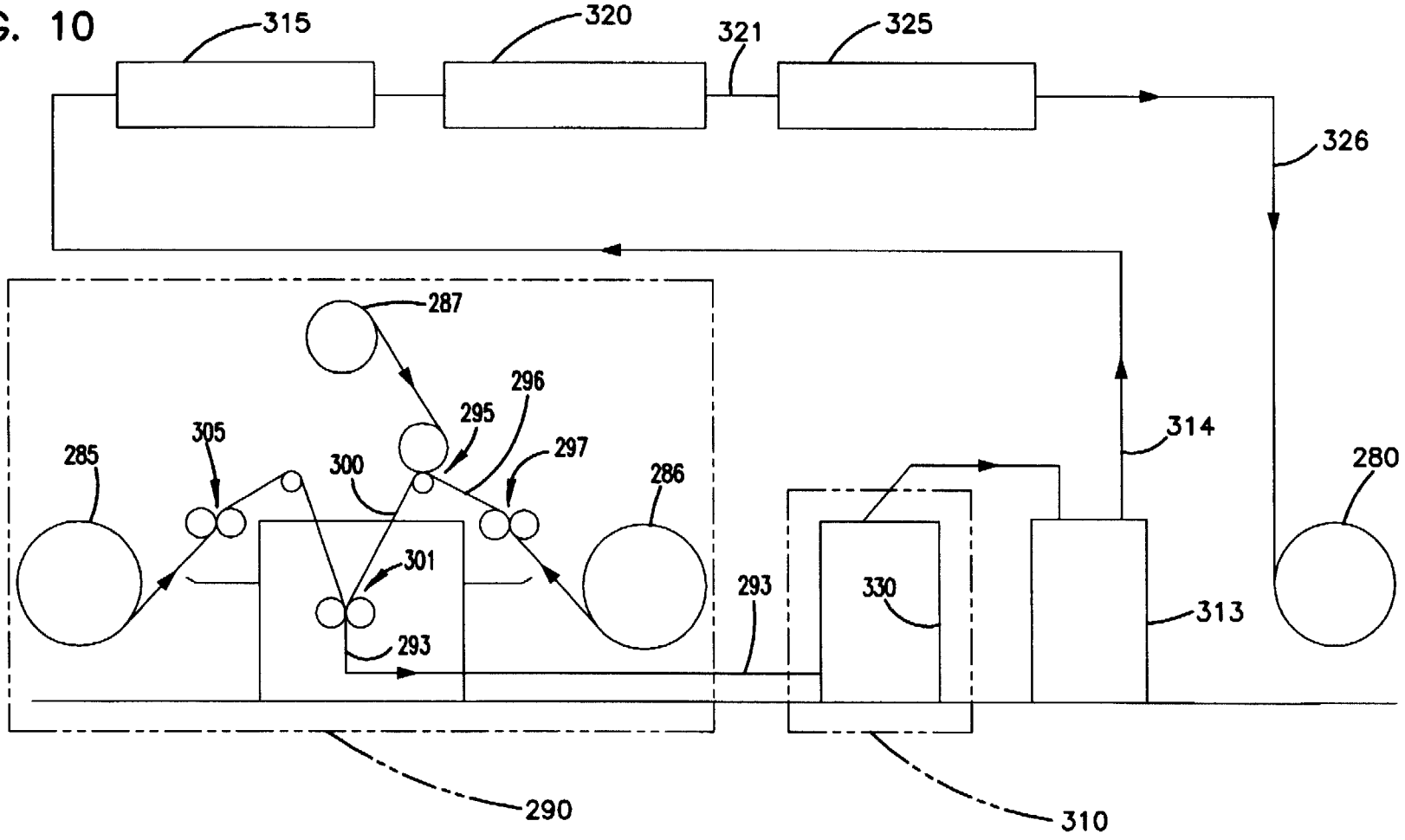
FIG. 10 is a schematic view of an alternate process for preparing a rollstock of blanks.

Attention is now directed to the schematic shown in FIG. 10. FIG. 10 is generally analogous to FIG. 9, and the same reference numerals are utilized to indicate similarly operating portions. In the arrangement of FIG. 10, as an alternative to using the optional hot roller or hot can system (as was indicated in FIG. 9 at 310) an optional forced-air drying system 330 is used. In general, it is foreseen that it would be conducted with air at about 100° to 200° F., depending primarily on the particular adhesive chosen and the residence time.

VI. Preferred Materials

Preferred materials will, in general, depend upon the particular embodiment. At the present, preferred materials are as follows.

For the two-ply or multi-ply arrangement of FIGS. 1–4, the preferred rollstock of microwave interactive material comprises an aluminum film vacuum deposited on Hoechst Celanese 2600 60 gauge polyester film, sufficient to give an optical density of 0.25±0.05 as measured by a Tobias densitometer. Such a material can be prepared by, and obtained from, Madico of Woburn, Mass. 01888.

For the two-ply arrangements depicted, the preferable heat sealable adhesive usable to form the heat seal pattern is a polyvinyl acetate homopolymer adhesive such as Duracet 12 available from Franklin International, Inc. of Columbus, Ohio. The seals, when such materials are used, can be formed in a conventional manner using the heated jaws of a heat sealing apparatus.

In the two-ply construction of FIGS. 1–4, the preferred adhesive for securing the metal side of the microwave interactive construction to the immediately adjacent paper, is a conventional laminating adhesive used for microwave interactive constructions in packages. Preferred ones are ethylene vinyl acetate copolymer adhesives, for example Product No. WC-3460ZZ from H. B. Fuller Company of Vadnais Heights, Minn.

In the two-ply arrangement of FIGS. 1–4, when the web used for the inner ply is a greaseproof paper, the preferred web is a flexible paper material having a basis weight no greater than about 25 pounds per ream, preferably within the range of 21–25 pounds. In such instances, it is preferably an FC807 (fluorochemical) treated paper having a grease-resistant character under the Scotchban® test of minimum kit 8. A usable material is Rhinelander greaseproof RHI-PEL 250, available from Rhinelander Paper Company of Rhinelander, Wis. 54501. FC807 is a chemical treatment available from 3M Company, St. Paul, Minn. It is noted that in some instances a grease-resistant character to the inner paper may be desirable, in spite of the fact that what is of greater importance with respect to this paper is greaseproofness. A reason is that a grease staining of the surface of the inner sheet of paper may be viewed through the outer layer, and be unattractive to the customer. Thus, treatments of the inner layer, especially its outer surface, for grease resistance character may be preferred.

A preferred material for use as the adhesive applied in the preferred pattern, for example the pattern of FIGS. 7 and 8, between the plies is Duracet 12. It is preferably applied in an amount, where printed, of about 5–6 lb/ream. It can be applied utilizing a variety of printing techniques, for example flexographic or gravure techniques.

What is claimed is:

1. A microwave popcorn package comprising:

(a) a flexible bag construction comprising inner and outer plies;

(b) a microwave interactive construction positioned between said inner and outer plies; said microwave interactive construction having a front side and a back side;

(c) said inner ply being bonded to said outer ply by an adhesive, said adhesive being oriented in an adhesive pattern, said adhesive pattern including:

(i) at least a first portion which comprises adhesive applied in a first pattern of lines covering no more than about 50% of the surface of a first one of said plies, in said first portion;

(ii) a first outer border of adhesive along an outer perimeter of said first one of said plies;

(iii) a central microwave interactive construction overlap region, said overlap region comprising a rectangular field of adhesive having: a width of at least 0.25 inches greater than a width of said microwave interactive construction; a length of at least 0.25 inches greater than a length of said microwave interactive construction; wherein said rectangular field of adhesive is a continuous rectangular pattern; and (d) said microwave interactive construction comprises a sheet of polyester film having a field of metallic material positioned thereon;

(i) said microwave interactive construction being oriented between said inner and outer plies with said field of metallic material oriented to overlap said microwave interactive construction overlap region.

2. A microwave popcorn package comprising:

(a) a flexible bag construction comprising inner and outer plies;

(b) a microwave interactive construction positioned between said inner and outer plies; said microwave interactive construction having a front side and a back side;

(c) said inner ply being bonded to said outer ply by an adhesive, said adhesive being oriented in an adhesive pattern, said adhesive pattern including:

(i) at least a first portion which comprises adhesive applied in a first pattern of lines covering no more than about 50% of the surface of a first one of said plies, in said first portion;

(ii) a first outer border of adhesive along an outer perimeter of said first one of said plies;

(iii) a central microwave interactive construction overlap region, said overlap region comprising a rectangular field of adhesive having: a width of at least 0.25 inches greater than a width of said microwave interactive construction; a length of at least 0.25 inches greater than a length of said microwave interactive construction; wherein said rectangular field of adhesive is a rectangular frame pattern having a central, non-adhesive covered area; and (d) said microwave interactive construction comprises a sheet of polyester film having a field of metallic material positioned thereon;

(i) said microwave interactive construction being oriented between said inner and outer plies with said field of metallic material oriented to overlap said microwave interactive construction overlap region.

3. A microwave popcorn package comprising:

(a) a flexible bag construction comprising inner and outer plies;

(b) a microwave interactive construction positioned between said inner and outer plies; said microwave interactive construction having a front side and a back side;

(c) said inner ply being bonded to said outer ply by an adhesive; said adhesive being oriented in an adhesive pattern, said adhesive pattern including:

(i) at least a first portion which comprises adhesive applied in a first pattern of lines covering no more than about 50% of the surface of a first one of said plies, in said first portion; said adhesive in said first portion comprising a pattern defining regular polygons;

(ii) a first outer border of adhesive along an outer perimeter of said first one of said plies; and (iii) a central microwave interactive construction overlap region, said overlap region comprising a rectangular field of adhesive having: a width of at least 0.25 inches greater than a width of microwave interactive construction; a length of at least 0.25 inches greater than a length of said microwave interactive construction; wherein said rectangular field of adhesive is a selected one of:

a rectangular frame pattern having a central, non-adhesive covered area; and a continuous rectangular pattern.

4. A microwave popcorn package according to claim 3 wherein:

(a) said rectangular frame pattern comprises borders from 0.25 to 1.0 inches wide.

5. A microwave popcorn package comprising:

(a) a flexible bag construction comprising inner and outer plies;

(b) a microwave interactive construction positioned between said inner and outer plies; said microwave interactive construction having a front side and a back side;

(c) said inner ply being bonded to said outer ply by an adhesive, said adhesive being oriented in an adhesive pattern, said adhesive pattern including:

(i) at least a first portion which comprises adhesive applied in a first pattern of lines covering no more than about 50% of the surface of a first one of said plies, in said first portion; and (ii) a central microwave interactive construction overlap region, said overlap region of said adhesive pattern comprising a rectangular field of adhesive having: a width of at least 0.25 inches greater than a width of said microwave interactive construction; a length of at least 0.25 inches greater than a length of said microwave interactive construction; wherein said rectangular field of adhesive is a selected one of:

a rectangular frame pattern having a central, non-adhesive covered area; and a continuous rectangular pattern.

6. A microwave popcorn package according to claim 5 wherein:

(a) said rectangular frame pattern comprises borders from about 0.25 to 1.0 inches wide.

7. A microwave popcorn package comprising:

(a) a flexible bag construction comprising inner and outer plies;

(b) a microwave interactive construction position between said inner and outer plies; said microwave interactive construction having a front side and a back side;

(c) said inner ply being bonded to said outer ply by an adhesive, said adhesive being oriented in an adhesive pattern, said adhesive pattern including:

(i) at least a first portion which comprises adhesive applied in a first pattern of lines covering no more than about 50% of the surface of a first one of said plies, in said first portion;

(ii) a central microwave interactive construction overlap region, said overlap region comprising a rectangular field of adhesive having: a width of at least 0.25 inches greater than a width of microwave interactive construction; and, a length of at least 0.25 inches greater than a length of the microwave interactive construction; and (d) said microwave interactive construction comprises a sheet of polyester film having a field of metallic positioned thereon;

(i) said microwave interactive construction being oriented between said inner and outer plies with said field of metallic material oriented to overlap said microwave interactive construction overlap region.

8. A microwave popcorn packages according to claim 7 wherein:

(a) said adhesive pattern in said first portion comprises a pattern defining regular polygons.

9. A microwave popcorn package according to claim 8 wherein:

(a) said adhesive pattern in said first portion comprises a pattern of hexagons.

10. A microwave popcorn package according to claim 7 wherein:

(a) said polyester film includes a field of metallic material on only one side thereof; and, (b) said microwave interactive construction is oriented in said package with said metal film directed toward said inner ply.

11. A microwave popcorn package according to claim 10 wherein:

(a) said adhesive pattern is positioned on said inner ply, before said inner and outer plies are laminated to one another.

* * * * *